United States Patent [19]

Pietzsch et al.

[11] 4,057,792

[45] Nov. 8, 1977

[54] OVERLOAD SAFETY DEVICE FOR TELESCOPIC CRANES

[75] Inventors: Ludwig Pietzsch; Knud Overlach; Peter Fuchs, all of Karlsruhe, Germany

[73] Assignee: Ludwig Pietzsch, Karlsruhe, Germany

[21] Appl. No.: 549,026

[22] Filed: Feb. 11, 1975

Related U.S. Application Data

[63] Continuation of Ser. No. 353,715, April 23, 1973, abandoned, which is a continuation-in-part of Ser. No. 79,589, Oct. 9, 1970, abandoned.

[30] Foreign Application Priority Data

Jan. 21, 1970 Germany ..... 2002484
Mar. 20, 1970 Germany ..... 2013388

[51] Int. Cl.[2] ..... G08B 21/00; G08B 29/00

[52] U.S. Cl. ..... 340/267 C; 212/39 R; 364/508

[58] Field of Search ..... 340/267 C; 212/39 R, 212/39 A

[56] References Cited

U.S. PATENT DOCUMENTS

| | | | |
|---|---|---|---|
| 3,586,841 | 6/1971 | Griffin | 212/39 R |
| 3,740,534 | 6/1973 | Kezer et al. | 340/267 C |
| 3,815,116 | 6/1974 | Fink | 340/267 C |
| 3,854,128 | 12/1974 | Yamagishi | 340/267 C |
| 3,870,160 | 3/1975 | Hutchings | 340/267 C |

*Primary Examiner*—Glen R. Swann, III
*Attorney, Agent, or Firm*—Herbert L. Lerner

[57] ABSTRACT

Overload safety device for telescopic cranes includes transmitter means for registering a working radius of a crane jib having a base jib member and transmitter means for registering a load applied to the jib, analog computer means operatively connected to both the first and second transmitter means for comparing a nominal value predetermined by the working radius with actual values furnished by the transmitter means for registering the load, and signal means responsive to a condition wherein the actual values equal the nominal value for releasing an overload signal, the nominal values being proportional to a permissible limit moment for a respective working medium, the permissible limit moment being composed of a moment of the jib weight and a moment for the permissible load, the transmitter means for registering the load being mounted at the base jib member of the crane jib and being adapted to measure the bending moment of the base jib member, the transmitter means for registering the load being an elongation measuring transmitter.

2 Claims, 9 Drawing Figures

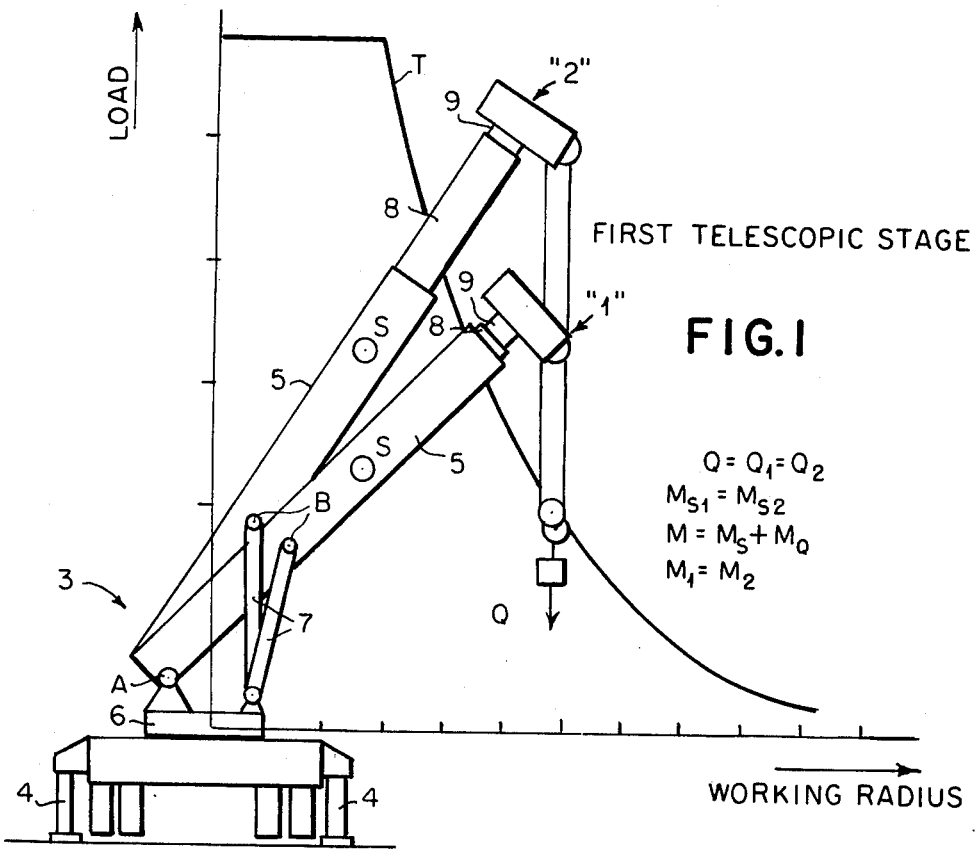
FIG. 1
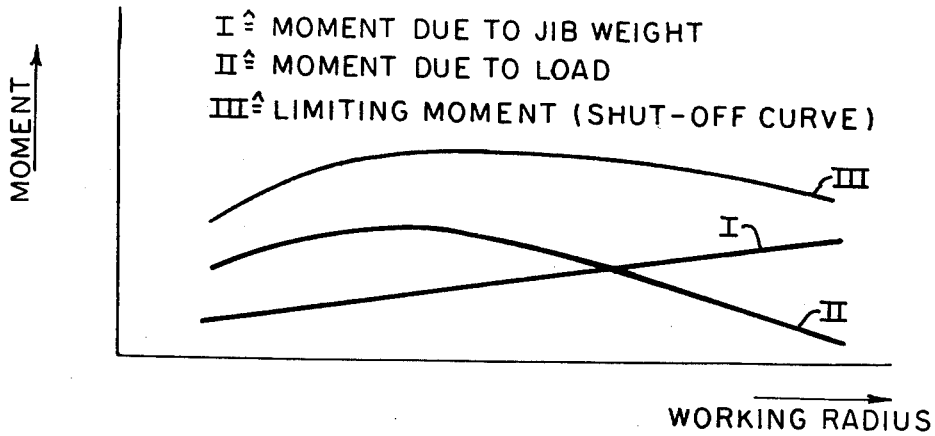
FIG. 2
FIG. 5
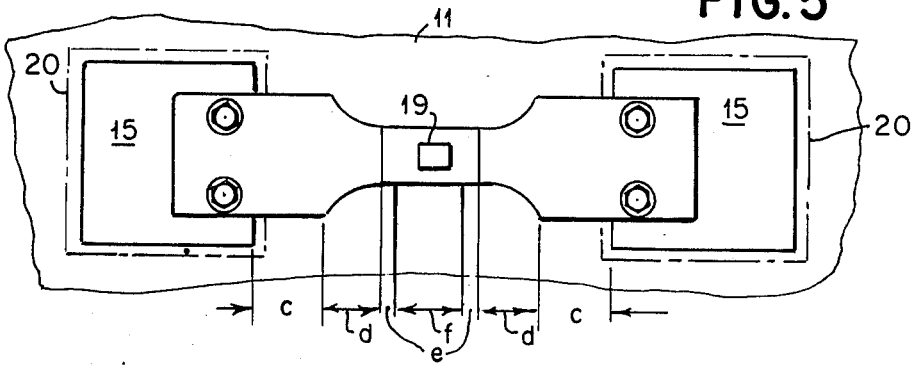

FIG. 3
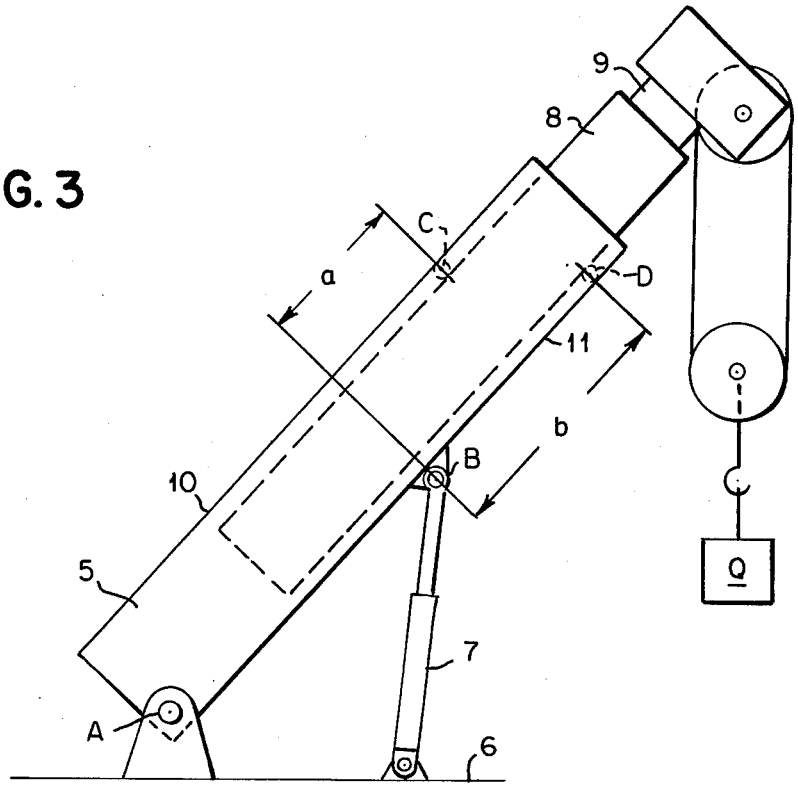
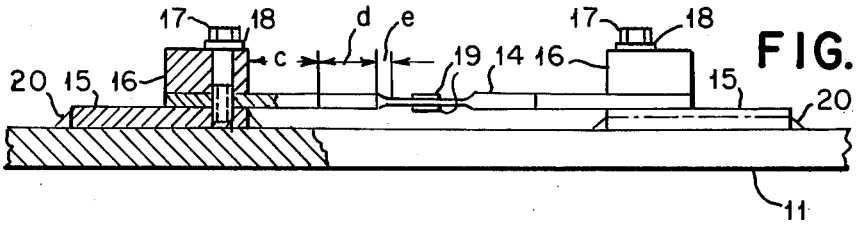
FIG. 4
FIG. 6
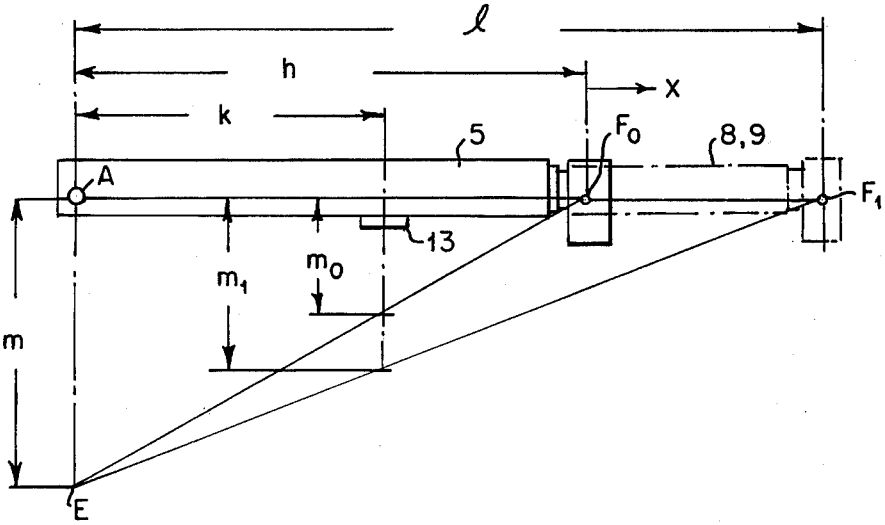

OVERLOAD SAFETY DEVICE FOR TELESCOPIC CRANES

CROSS-REFERENCES TO RELATED APPLICATIONS

This application is a continuation of application Ser. No. 353,715, filed Apr. 23, 1973, now abandoned, which was a continuation-in-part of application Ser. No. 79,589, filed Oct. 9, 1970, now abandoned.

The invention relates to overload safety device for telescopic cranes and, more particularly, to such overload safety device for telescopic cranes having transmitters for registering the working radius and the load as well as an analog computer wherein the nominal value predetermined by the working radius is compared with the actual values furnished by the transmitter for registering the load, and, when the actual values are equal to the nominal values, an overload signal is released.

In heretofore known overload safety devices of this general type, the permissible load values are given as the nominal values. The lead transmitters are force transmitters whose actual values are compared to the nominal values. The safety device attained in this manner is unsatisfactory especially for telescopic cranes since tilting or tipping thereof can occur not only due to a too-heavy load but also due to an excessive working radius of the jib. The moment of the jib weight can be as much as ten times the load moment for large working radii. Besides the jib moment, external forces such as wind forces, diagonal pulling and too-great acceleration can also help produce tipping of the crane.

It is accordingly an object of the invention to provide overload safety device of the aforementioned type wherein the aforedescribed effects and especially the variable jib weight moment are registered together.

SUMMARY OF THE INVENTION

With the foregoing and other objects in view, there is provided in accordance with the invention overload safety device for telescopic cranes comprising transmitter means for registering a working radius of a crane jib having a base jib member and transmitter means for registering a load applied to the jib, analog computer means operatively connected to both the first and second transmitter means for comparing a nominal value predetermined by the working radius with actual values furnished by the transmitter means for registering the load, and signal means responsive to a condition wherein the actual values equal the nominal value for releasing an overload signal, the nominal values being proportional to a permissible limit moment for a respective working radius, the permissible limit moment being composed of a moment of the jib weight and a moment for the permissible load, the transmitter means for registering the load being mounted at the base jib member of the crane jib and being adapted to measure the bending moment of the base jib member, the transmitter means for registering the load being an elongation measuring transmitter.

With an overload safety device of such construction, all effects causing tilting of the crane, inclusive of wind moments, diagonal pulling and acceleration moments, and above all the moment of the jib weight, which is variable with the working radius of the jib, are detected. There is thereby provided considerably increased reliability with respect to heretofore known overload safety devices.

If a load curve and thereby a limiting moment curve is provided for each telescopic stage or range of the crane, the nominal values for a telescopic stage or range is advantageously linearly variably preprogrammed in the entirety thereof.

This means that the nominal value curve, for example, during the transition thereof from one to the other telescopic stage is displaced parallel to itself or varied linearly in the inclination thereof in accordance with how it is required to be adjusted to the new limiting moment curve.

In order that the comparison between the permissible limiting moment and the value measured by the transmitter for registering the load should provide information regarding the actual existing relationships, both the type of transmitter employed as well as the location at which it is applied must be determined so that the transmitter actually measures a value that is comparable to the nominal value and is of equal maximum. As a solution for this special problem, there is provided further in accordance with the invention, an overload safety device with a transmitter measuring a bending moment, the transmitter being located at a base jib member of the telescopic crane, in a range located between a pivot point thereon, to which a luffing cylinder for the crane is connected, and a support point for the telescopic stages of the crane.

With a transmitter so constructed and disposed, a moment corresponding to the total moment is measured free of hysteresis, only the bending moment and not the force components acting in direction of the longitudinal axis of the jib being registered. Due to the aforedescribed arrangement of the transmitter, the component of the jib weight moment virtually exclusively causing the tilting moment of the crane is measured and not that component of the jib weight moment which promotes the stationary moment. Only the first-mentioned component is of interest, however, for tilting reliability of the crane.

In accordance with other features of the invention, a transmitter is located at the lower chord of the base jib member and in the range between the pivot point thereof, to which the luffing cylinder is connected, and to a supporting point for the telescopic stages opposite the lower chord. If the transmitter is to be secured to the upper chord of the base jib member, it is disposed in the range between the pivot point connection thereto of the luffing cylinder and the support point for the telescopic stages located opposite the upper chord.

In accordance with another feature of the invention, the transmitter is constructed as an elongation measuring transmitter or transducer with elongation measuring strips.

It has been known to secure elongation measuring strips to a structural component whose stresses are to be measured. In many cases it is impossible to secure the elongation measuring strips with the required exactitude and with the temperature equalization or adjustment required for sustained or long-term measuring, directly to the structural component. This is especially true for the base jib member of a telescopic crane which is exposed to very rough operating conditions. Furthermore, it is found that the elongations to be measured are very small so that the measuring signals are capable of being amplified only with great difficulty and not with the required accuracy. If elongation measuring strips that had been directly glued to the structural component should come off, new elongation measuring strips must be reglued thereon under even more difficult conditions. In order to glue the elongation measuring strips back on, only specialized technical personnel trained in this art are able to perform this work. They must then travel to the place of manufacture or to the location at which the telescopic crane is installed in order to carry out the assembly of the elongation measuring strips at the base jib member.

In order to produce an elongation measuring transmitter with elongation measuring strips which can be assembled or mounted at the base jib member by personnel that are not especially trained therefor, and which delivers measuring signals that are sufficiently strong even for relatively low moments and that are relatively simple to amplify, there is provided in accordance with still another feature of the invention an elongation measuring transmitter comprising a carrier for the elongation measuring strips that is securable to the base jib member, the carrier having between the securing ends thereof, a length of relatively slight rigidity wherein the elongation measuring strips are glued or bonded. Advantageously, the cross-section of the length of relatively slight rigidity tapers in longitudinal direction toward the middle of the carrier, the elongation measuring strips being glued or bonded to the carrier, in the middle of the latter.

With an elongation measuring transmitter of such construction, the following advantages are especially attainable: The elongation measuring strips are previously glued onto the carrier member by the manufacturer of the transmitter so that the transmitter only has to be secured to the production or installation location of the structural component, an operation which can be carried out also by unskilled personnel. Due to the fact that the elongation measuring strips can be glued to the length of relatively slight rigidity, an elongation transmission is produced which results in a greater elongation of the elongation measuring strips than of the respective base jib ranges. The measuring signal is thus preamplified "naturally" so that it can then relatively easily be further amplified, or requires no further amplification at all.

In order to avoid measuring deviations which can be produced due to asymmetric arrangement of the elongation measuring transmitter, in accordance with an added feature of the invention, the elongation measuring transmitter is secured in transverse direction between the upper and lower chords of the base jib member. Moreover, according to the invention, a plurality of elongation measuring transmitters may be distributed in parallel arrangement uniformly over the width of the upper and lower chords so as to be able to compensate for different elongations of the base member.

Also according to the invention, a plurality of elongation measuring transmitters are provided at one level around the base jib member in order to compensate for temperature variations and local varying elongation changes of the base jib member that are contingent on the temperature variations.

In the heretofore known overload safety devices, it has been found that for the same working radius of the jib, different moments are measured for different jib lengths, although theoretically, equal moments should have been measured.

Measurements and theoretical considerations have indicated that the measurement error initially increases relatively greatly with increasing jib length and then tends to reach a fixed limiting value. In order to ensure that substantially the same moment will always be measured for constant working radius at all adjustable jib lengths and for equal load, in accordance with an additional feature of the invention, it is provided that with increasing length of the telescopic jib, the actual values are variable inversely proportionately or the nominal values are varied proportionately to the measurement value for the total moment, and for this purpose, a resistance is connected in front of or behind the load transmitter and is variable in resistance value proportionately to the length of the telescopic jib, and a fixed resistance is further connected in parallel to the variable resistance.

With an overload safety device of such construction for telescopic cranes the increase in the measurement value occurring with increasing jib length are again equalized by the correspondingly reduced actual or nominal values.

In this embodiment of the invention, as the telescopic jib length increases, the actual values are varied inversely proportionately to the measured value for the entire moment. The solution provided in accordance with the invention by the parallel connected resistances is especially simple from the viewpoint of instrument technology. It renders superfluous the use of a function resistance with a winding adjusted to the measurement error function, because the given circuit, of its own nature, delivers output voltages which are actually inversely proportional to the increase in measurement value which varies with the telescopic jib lengths.

According to another feature of the invention, therefore, the elongation measuring strips are bonded in opposite pairs on the tension and compression sides of the pivot pin and are connected into a bridge circuit.

In order to check the function of overload safety devices of the heretofore known type it has been necessary until now to suspend standard loads from the jib and to lift the same until the overload safety device shuts off the crane when a specific working radius predetermined by the length of the jib and the inclination of the jib is attained. Such standard loads must be carried with the crane, a practice which is costly and which has generally not been followed in the past. Even when standard loads are provided, the aforedescribed known checking method is complex and time-consuming.

A reliable and simpler testing of overload safety devices in accordance with the invention of the instant application is effected by selecting one or more working radii for respective given conditions of outfitting of the crane wherein the jib weight alone has produced the permissible limiting moment for the respective outfitting condition, and the handicap of the corresponding nominal value is brought into the respective working radius (by outward luffing and/or by outward extension of the jib).

With the method according to the invention it is possible to effect a considerably simplified as well as more rapid and more accurate testing of overload safety devices of the given type with respect to the heretofore known method without having to suspend and raise standard loads on the crane hook. The separate standard load is replaced by the jib weight in the method of the invention. The jib weight like a standard load represents a load magnitude that is known as to size and that is reproducible, that is, however, always available and must not be suspended independently on the crane. For a correct functioning of the overload safety device, the latter shuts off the crane at the selected working radius solely due to the jib weight. Merely by checking a measuring point, i.e., of a working radius and of outfitting conditions, reliable information is obtained with the method of the invention with respect to the functioning of the overload safety device, for example, the sensitivity and null point stability of the measuring transmitter employed therewith. Under special circumstances one might check several measuring points, in which case other selected working radii and outfitting conditions are only required to be adjusted.

In the overload safety devices of the afore-described type, the nominal values are automatically coordinated by the respective outfitting condition and the working radius. If that is not the case, the nominal values coordinated with the outfitting conditions and the working radius must be adjusted by hand to supplement the aforedescribed method.

The method according to the invention can be simplified especially if the functioning of the overload safety device is to be tested for several working radii by the fact that for different working radii determinable with the aid of a measuring band or a measuring instrument, the corresponding nominal values for the forces are compared in accordance with a table with the measured values for the respective working radius, whereby the overload safety device shuts off.

A device for carrying out the method of the invention comprises measuring instruments for checking the working radius and the jib inclination angle and/or the nominal value for forces and/or the actual value for the forces, the measuring instruments being installed in the crane cab.

Other features which are considered as characteristic for the invention as set forth in the appended claims.

Although the invention is illustrated and described herein as overload safety device for telescopic cranes, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawings, in which:

BRIEF DESCRIPTION OF THE DRAWING

FIG. 1 is a diagrammatic view of a telescopic crane in two positions thereof superimposed on a load curve;

FIG. 2 is a so-called "shut-off curve" of the telescopic crane;

FIG. 3 is an enlarged view of the telescopic crane of FIG. 1 showing locations thereon of an elongation measuring transmitter according to the invention;

FIGS. 4 and 5 are partly sectional side elevational and plan views of an elongation measuring transmitter according to the invention;

FIG. 6 is a moment diagram of the telescopic jib of the crane according to the invention;

DESCRIPTION OF THE PREFERRED EMBODIMENT

Figure 8:
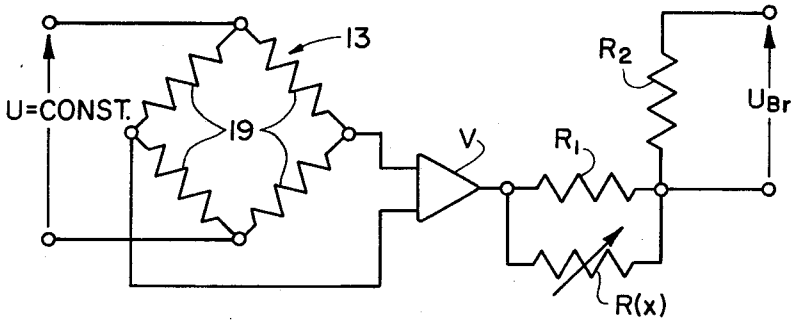
FIGS. 7 and 8 are respective circuits for correcting the moment measurement error.

Referring now to the drawings, and first particularly to FIG. 1 thereof, there is shown a telescopic crane 3 according to our invention, in operative position with laterally lowered supports 4. The crane 3 has a telescopic jib formed of a base jib member 5, which is articulatingly connected at A to a turntable 6 and at B to a luffing or whipping cylinder 7, as well as two telescoping cylindrical members 8 and 9.

The jib 5, 8, 9 is shown in two positions "1" and "2" in FIG. 1, the first telescoping cylindrical member 8 being at least partly extended in both positions "1" and "2" of the jib 5, 8, 9, the crane 3 being therefore in the first telescopic stage. In the position "2", the jib 5, 8, 9 is more steeply inclined than in the position "1" thereof. However, the telescope member 8 extends farther out from the base jib member 5 in the position "2" than in the position "1" so that it has the same working radius in both positions. Therefore, the tilting movement or maximum torque composed substantially of the jib moment and the moment of the load Q is equal the same in both positions "1" and "2".

Consequently, a common point on the load curve T, on which the telescopic crane of FIG. 1 is superimposed and from which the permissible loads for a telescopic range are determinable for the respective working radius of the jib, corresponds to both positions "1" and "2". Conversely, maximum torque or moment is a function of the single variable, the working radius.

Frequently, for telescopic cranes, a separate load curve is assigned to each telescopic stage, whereby the increasing danger of buckling of the jib with increasing length of the jib is taken into consideration. In the interest of greater clarity, only the load curve for the first telescopic stage is shown in FIG. 1.

The center of gravity of the jib is indicated at S. It is apparent from FIG. 1 that for a steady or constant load $Q=Q_1=Q_2$, in spite of the shift of the center of gravity S in the position "2" outwardly in the direction of the jib, the respective jib moments about the foot A remain $M_{s1}=M_{s2}$. Since the total moment is the sum of the jib moment $M_s$ and the load moment $M_q$, it is evident that the total moment $M_1$ in the position "1" is equal to the total moment $M_2$ in the position "2".

An example of a limiting moment curve, which results from superposition of the jib moment and the permissible load moment in accordance with the equation $M=M_s+M_q$ is shown in FIG. 2.

To avoid any possible confusion that might arise from the view in FIG. 1, the telescopic crane is again shown in FIG. 3, but, however, only in a single position thereof.

In FIG. 3, the limits are shown, within which an elongation measuring transmitter with elongation measuring strips for registering the bending moment of the base jib is disposed so that all values causing instability or tilting of the crane are jointly registered.

If the elongation measuring transmitter (not shown in FIG. 3) is located on the upper chord 10 of the base jib 5, it is secured within the range *a* between a roller C forming an upper supporting point for the telescoping members 8 and 9 at the base jib 5 and the articulating connecting point B of the luffing cylinder 7 to the upper chord of the base jib 5.

If, however, the elongation measuring transmitter, is to be located at the lower chord 11 of the base jib 5, it is then secured within the range $b$ between a roller mounted at the base jib and forming a supporting point D for the telescoping members 8 and 9 at the base jib 5 and the articulating connecting point B of the luffing cylinder 7 at the lower chord of the base jib.

The range $a$ within which the transmitter is to be fastened to the upper chord can be extended to the range $b$ if the telescoping members at the upper chord support one another differently from that illustrated in FIG. 3, for example with a slide plate at the end of the telescoping member 8.

In FIGS. 4 and 5, a preferred embodiment of the elongation measuring transmitter according to the invention is shown in detail.

The elongation measuring transmitter is formed of a carrier 14 which is clamped at its ends respectively between a flat plate 15 and a block 16 by means of screws 17. The flat plate 15 extends over a comparatively large range whose dimensions considerably exceed those of the carrier ends whereby stressing of the base jib can be introduced into the carrier 14 free of trouble and without any buckling of a cooperating component.

Between each block 16 and the heads of the screws 17, plate springs 18 are disposed which are supposed to compensate for a slackening and change in prestressing of the screws resulting from vibrating or jolting movements or variations of temperature.

The carrier 14 has the same cross-section initially up to the spacing C from each fastening end thereof, and then, as seen in the plan view of FIG. 5, narrows down with smooth curves on both sides of a range or region d which is connected to the region C.

A further narrowing or tapering of the carrier 14 takes place in the region e due to a reduction in the thickness thereof (FIG. 4) with smooth curves on both sides.

Two elongation measuring strips respectively are bonded or glued opposite one another in the middle of the carrier 14 at the location thereof having the smallest cross-section (indicated by the rectangle 19 in FIGS. 4 and 5) and are connected in a bridge circuit so that a pair of elongation measuring strips located opposite one another in the bridge are glued on one side, and the other pair of elongation measuring strips located opposite one another in the bridge are glued on the other side. Thereby, unavoidable, bending stresses impressed on the carrier 14 during the mounting thereof, are compensated.

To mount the carrier 14, the flat plates 15 are initially welded at 20, in the embodiment of FIGS. 4 and 5, to the lower chord 11 in the region $b$ thereof (note FIG. 3). Then the carrier 14 is placed on the plates 15, and the blocks 16 are clamped by means of the screws 17 against the respective ends of the carrier 14.

In the overload safety device described to here, to has become apparent that the actual values are subjected to a measurement error which increases with increasing jib length greatly at first, and then tending toward a fixed limit value.

This is explained in light of FIG. 6 wherein the telescopic jib is shown in two positions, namely in fully telescoped or collapsed position with the length $h$, and in fully extended position with the length 1. The load transmitter 13 is provided with the elongation measuring strips 19 at the base jib member 5 at a spaced distance $k$ from the pivot point A.

The layout of FIG. 6 applies only to a specific working radius of the jib and a specific load.

At the level of the pivot point A, a moment m of this fixed load acting at the pivot point A is applied perpendicularly to the telescopic jib, the moment $m$ remaining the same for all jib lengths due to the invarying working radius. From the end point E of the length $m$, a line is drawn respectively to the points of action $F_0$ and $F_1$ of the given load. At these drawn lines the magnitude of the moment can be plotted or drawn respectively perpendicularly to the telescopic jib.

It is apparent that, at the level of the load transmitter 13, two different moments, namely the moment $m_o$ for the telescoped or retracted position of the jib and the moment $m_1$ for the fully extended position of the jib, are measured. The difference between the size of the moments $m_1$ and $m_o$ depends upon the level arm ratios and is a determining factor for the formation and the size of the measurement error of the load transmitter 13. This measurement error is capable of being represented by the following formula:

$$\frac{m(x)}{m_o} = \frac{1 - \frac{k}{x+h}}{1 - \frac{k}{h}} \tag{1}$$

In equation (1), $x$ is a coordinate extending toward the right-hand side of FIG. 6 in direction of the telescopic jib, the coordinate x beginning at the location $F_0$ of the telescopic jib.

Equation (1) represents a hyperbola.

Figure 7:
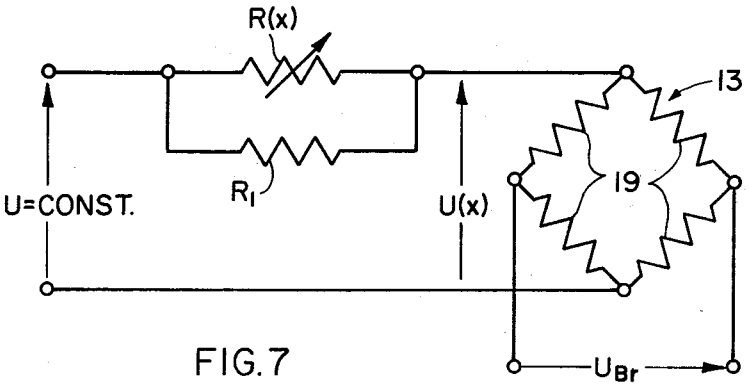

In FIG. 7, a circuit is shown which includes the load transmitter 13 with the elongation measuring strips 19 connected in a bridge circuit. A resistance R(x), which is variable proportionally to the length of the telescopic jib, is connected in series with the bridge circuit, and a resistance $R_1$ is connected in parallel with the variable resistance R(x). The circuit of FIG. 7 is energized with a constant voltage U.

The relationship between the constant voltage U and the bridge energizing voltage U (x) is as follows:

$$\frac{U(x)}{U} = \frac{1}{1 + \frac{R_1}{[1 + R_1/R(x)]\, R_{Br}}} \tag{2}$$

In equation (2), $R_{Br}$ is the total resistance of the load bridge.

Equation (2) also represents a hyperbola.

The voltage U ($x$) acting at the input to the bridge has the following relationship to the bridge output voltage $U_{Br}$:

$$U_{Br} = K_1 \cdot U(x) \cdot \epsilon \tag{3}$$

which is given by the measuring method with elongation measuring strips connected in a measuring bridge.

In equation (3), $U_{Br}$ is the actual voltage at the output to the circuit, $k_1$ is a constant, and $\epsilon$ is the elongation associated with the error of the moment measurement, the elongation $\epsilon$ being proportional to the moment. If the error for the moment measurement is to be compensated for, the following condition must be met:

$$m(x) \cdot U(x) = \text{const.} \tag{4}$$

i.e. the hyperbola according to equations (1) and (2) must extend reciprocally to one another.

This condition is complied with due to the parallel connection of the resistances R (x) and $R_1$ in FIG. 7.

It only depends upon the correct selection of the sizes of these resistances to be able to effect compensation of the measurement error curve [equation (1)] by the voltage correction curve [equation (2)] so that, for all jib lengths and equal load and equal working radius, the same moment will always be measured.

The circuit of FIG. 8 differs from that of FIG. 7 in that the parallel resistance R ($x$), $R_1$ are connected behind the load bridge 13, an amplifier V being provided between the resistances R ($x$), $R_1$, on the one hand, and the load bridge 13, on the other hand. Furthermore, behind the resistances R ($x$) and $R_1$, a resistance $R_2$ of fixed value is connected thereto, the corrected actual voltage $U_{Br}$ being measurable across the resistance $R_2$.

Figure 9:
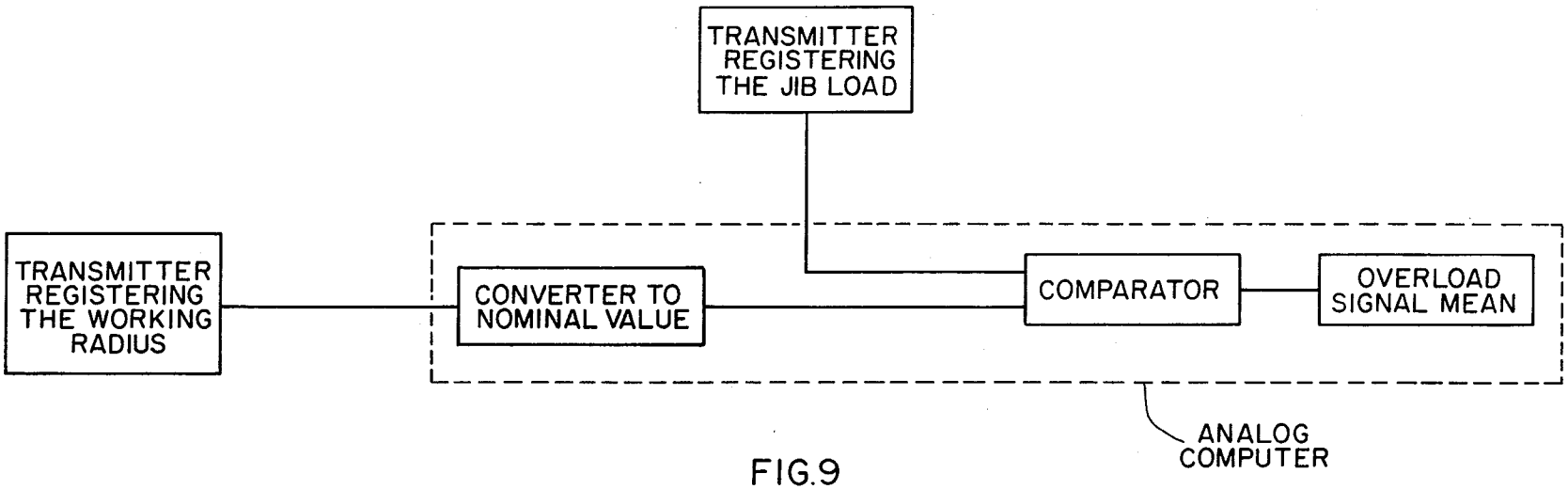
FIG. 9 is a highly schematic view of the overload safety device of the invention.

In FIG. 9 there is shown very schematically, the overload safety device of the invention. As seen in this figure, a signal is sent from the transmitter which registers the working radius of the jib to an analog computer wherein the signal is converted to a nominal value. In addition, a signal representing the actual value of the jib load is sent from a transmitter also to the analog computer. The nominal value and the actual value are then compared in the analog computer and, in response to a condition wherein the actual value equals the nominal value, an overload signal is released by suitable signaling means. The construction of the analog computer and the equipment associated therewith has not been described or illustrated since it is not believed to be necessary for the invention herein and would merely serve to lengthen this disclosure unduly and, in fact, tend to obscure the invention. Details of the construction thereof are furthermore well known in the art.

We claim:

1. Overload safety device for telescopic cranes comprising transmitter means for registering a working radius of a crane jib having a base jib member and transmitter means for registering a load applied to the jib, analog computer means operatively connected to both said first and second transmitter means for comparing a nominal value predetermined by the working radius with actual values furnished by the transmitter means for registering the load, and signal means responsive to a condition wherein said actual values equal said nominal value for releasing an overload signal, said nominal value being proportional to a permissible limit moment for a respective working radius, said permissible limit moment being composed of a moment of the jib weight and a moment for the permissible load, said transmitter means for registering the load being mounted on said base jib member of said crane jib and being adapted to measure the bending moment of said base jib member, a variable resistance serially connected to said bending moment measuring transmitter means, said resistance having a magnitude proportional to the variable length of said telescopic crane, and further including a fixed resistance connected in parallel with said variable resistance.

2. Method of checking an overload safety device including transmitter means for registering a working radius of a crane jib and transmitter means for registering a load applied to the jib and means for comparing a nominal value predetermined by the working radius with measured actual values furnished by the transmitter means for registering the load, and signal means responsive to a condition wherein said actual values equal said nominal value for releasing an overload signal, which comprises selecting a plurality of working radii for respective given outfitting conditions of the crane, wherein the jib weight alone produces a limiting moment permissible for the respective outfitting condition, and selectively outwardly luffing and extending the jib into respective working radii to which predetermined nominal values correspond, and comparing said predetermined nominal values corresponding to said working radii with measured actual values for the respective working radii at which the overload signal is released.

* * * * *